US008602829B2

(12) United States Patent
Kosyanchuk et al.

(10) Patent No.: US 8,602,829 B2
(45) Date of Patent: Dec. 10, 2013

(54) CABLE CONNECTOR WITH INTEGRATED SHOE

(75) Inventors: Elena G. Kosyanchuk, Cedar Rapids, IA (US); Daniel G. Hollinger, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 75 days.

(21) Appl. No.: 13/428,821

(22) Filed: Mar. 23, 2012

(65) Prior Publication Data

US 2013/0252486 A1 Sep. 26, 2013

(51) Int. Cl.
*H01R 4/36* (2006.01)

(52) U.S. Cl.
USPC ..... 439/813

(58) Field of Classification Search
USPC ..... 439/814, 791, 798, 797, 771, 727, 762; 174/72 B
See application file for complete search history.

(56) References Cited

U.S. PATENT DOCUMENTS

| | | | | |
|---|---|---|---|---|
| 3,171,888 | A * | 3/1965 | Stanback | 174/72 B |
| 3,325,776 | A * | 6/1967 | Eppler | 439/791 |
| 3,344,394 | A * | 9/1967 | Kingsbury et al. | 439/814 |
| 3,688,247 | A * | 8/1972 | Prodel | 439/416 |
| 3,706,437 | A * | 12/1972 | Eberhardt | 248/230.4 |
| 4,327,887 | A * | 5/1982 | Kumakura | 248/73 |
| 4,355,852 | A * | 10/1982 | Bachle | 439/92 |
| 4,384,753 | A * | 5/1983 | Mixon, Jr. | 439/92 |
| 5,005,104 | A | 4/1991 | Grunert et al. | |
| 5,533,913 | A | 7/1996 | Boehm et al. | |
| 6,280,264 | B1 | 8/2001 | Whipple et al. | |
| 6,664,469 | B1 * | 12/2003 | Sweeney | 174/51 |
| 7,537,494 | B1 * | 5/2009 | Umlauf | 439/798 |
| 8,025,508 | B2 * | 9/2011 | Parker et al. | 439/92 |

FOREIGN PATENT DOCUMENTS

| | | | |
|---|---|---|---|
| AU | 2009202376 | B2 | 12/2011 |
| DE | 2042692 | A1 | 3/1971 |

OTHER PUBLICATIONS

Square D; Molded Case Circuit Breakers QOM1/QOM2; Dated 1997; (8 pages).
Schneider Electric; Publication Specification, Mechanical Lug Kits for H-and J-frame Circuit Breakers; Printed Apr. 11, 2012 (5 pages).
Square D; PowerPact® H- and J-Frame Circuit Breakers in 15a to 250A; Dated 2004 (2 pages).

(Continued)

*Primary Examiner* — Alexander Gilman
(74) *Attorney, Agent, or Firm* — Locke Lord LLP

(57) ABSTRACT

A lug having an integrated shoe for fastening the lug to a conductor and a terminal of a circuit breaker. The lug includes a housing and a cavity in the housing configured to receive the electrical conductor. The shoe has a hinge connecting the shoe to an inner wall of the housing. A slot is located adjacent to the shoe such that the shoe is positioned between the cavity and the slot, which receives the terminal. A hole in the housing receives a fastener that extends into the cavity. A force applied to the fastener urges the conductor to clamp against the shoe to cause it to deflect about the hinge and to press against the terminal to hold the lug in a secure relationship relative to the terminal and to hold the conductor in a secure relationship relative to the lug.

18 Claims, 4 Drawing Sheets

(56) References Cited

OTHER PUBLICATIONS

Square D; QOM2 Main Circuit Breaker for QO® Series S_and HOM® Series S_Load Centers; Dated Mar. 2004 (2 pages).

Square D; QOM2 Tenant-main Circuit Breakers for Meter-Pak® Meter Centers; Dated Aug. 2003; (4 pages).

International Search Report corresponding to co-pending International Patent Application Serial No. PCT/US2013/030655, European Patent Office, dated May 22, 2013; (5 pages).

International Written Opinion corresponding to co-pending International Patent Application Serial No. PCT/US2013/030655, European Patent Office, dated May 22, 2013; (6 pages).

* cited by examiner

FIG. 5
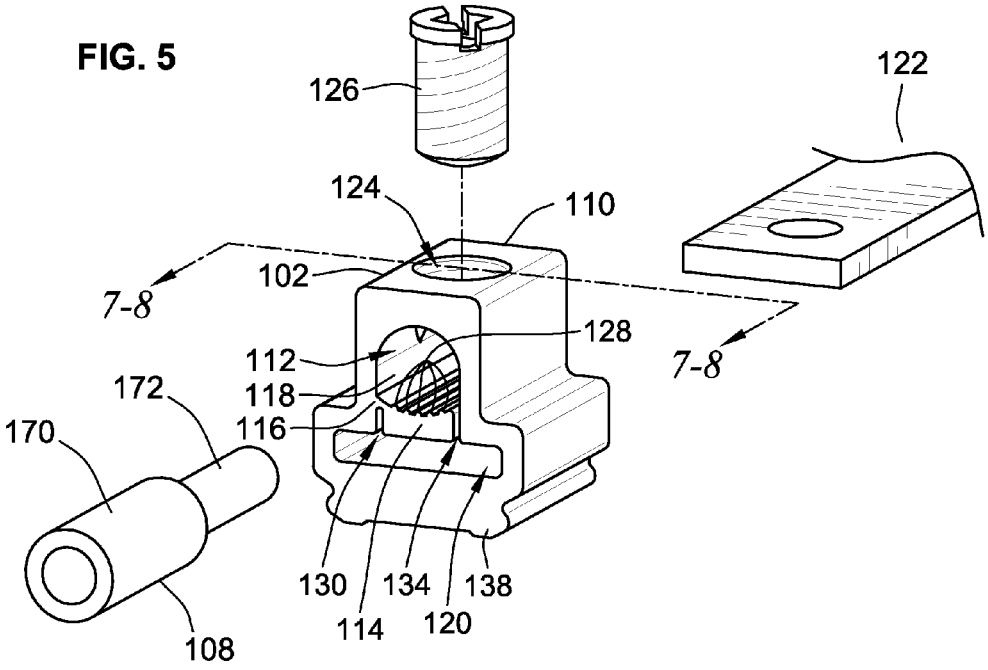
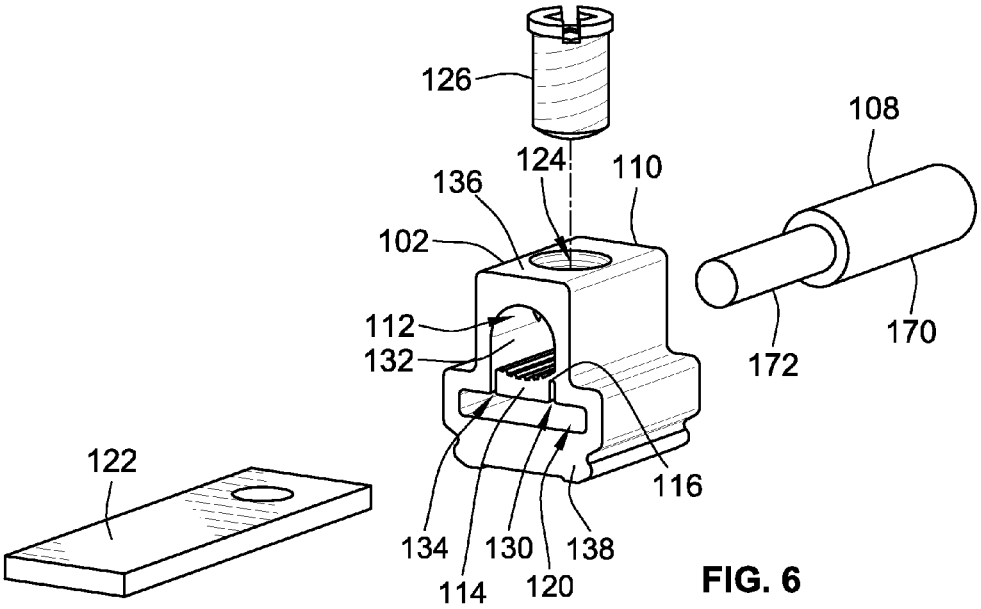
FIG. 6

CABLE CONNECTOR WITH INTEGRATED SHOE

FIELD OF THE INVENTION

Aspects of the present disclosure relate to a lug having an integrated shoe and that is used to connect an electrical conductor to a terminal of a piece of electrical distribution equipment, such as a circuit breaker.

BACKGROUND

Electrical distribution equipment, such as circuit breakers, have exposed terminals to which electrical cables or conductors are electrically coupled to carry electrical current between the equipment and a power source or load. A lug can be used to mechanically and electrically couple a conductor, a bus bar, or a crimp-on connector to the terminal. Typically, the conductor is fastened to the lug, and the lug is fastened to the terminal separately, requiring at least two fasteners to couple the conductor to the terminal using the lug. Also, terminals can have fairly large holes through them, which are used to fasten bus bars or crimp-on connectors instead of round cables or wire conductors, and these large holes create opportunities for the conductor to shear while the conductor is being fastened to the lug. The conductor is also brought into direct physical contact with the terminal in conventional arrangements, so the hole in the terminal provides an open area for the cable or conductor to shear as the conductor is pressed against the terminal by a fastener. In addition, the smooth surfaces of the terminal and the conductor do not always provide a good electrical conduction interface when oxidation is present on the surface of the conductor.

What is needed is an improved lug that overcomes these and other shortcomings.

BRIEF SUMMARY

A lug having an integrated shoe and that is clamped to a terminal of a circuit breaker by tightening a wire binding screw, which in turn presses the cable against the shoe to clamp the lug to the terminal using a single fastener and without the terminal being in direct physical contact with a wire conductor or cable received in the lug. Only one fastener is needed to secure the lug to both the conductor and to the terminal without having to fasten the lug to the terminal separately or with a separate fastener. The shoe is a material between the conductor and the terminal that is hinged to deflect when a force is applied to the fastener. The shoe deflects and presses against the terminal, securing the terminal to the lug while also securing the conductor to the lug. Optional grooves on a surface of the shoe facing the conductor helps to grip the conductor and obtain a more secure mechanical and electrical connection between the conductor and the shoe and to penetrate through oxidation that may be on the surface of the conductor. Interposing the shoe between the conductor and the terminal also eliminates shearing of the conductor that can occur during tightening because of a hole in the terminal that accommodates bus bars or crimp-on connectors fastened to the terminal. Because the shoe is integrated with the lug, a separate shoe is not required to be manually installed when connecting the conductor to the lug.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

FIG. 5 is an exploded perspective view of a front of the lug shown in FIG. 2, a fastener, a terminal, and a conductor according to an aspect of the present disclosure;

FIG. 6 is an exploded perspective view of a back of the lug, fastener, terminal, and conductor shown in FIG. 5 to illustrate how the cavity and the terminal-receiving slot of the lug is open at both ends;

The foregoing and other advantages of the present disclosure will become apparent upon reading the following detailed description and upon reference to the drawings.

DETAILED DESCRIPTION

Figure 1:
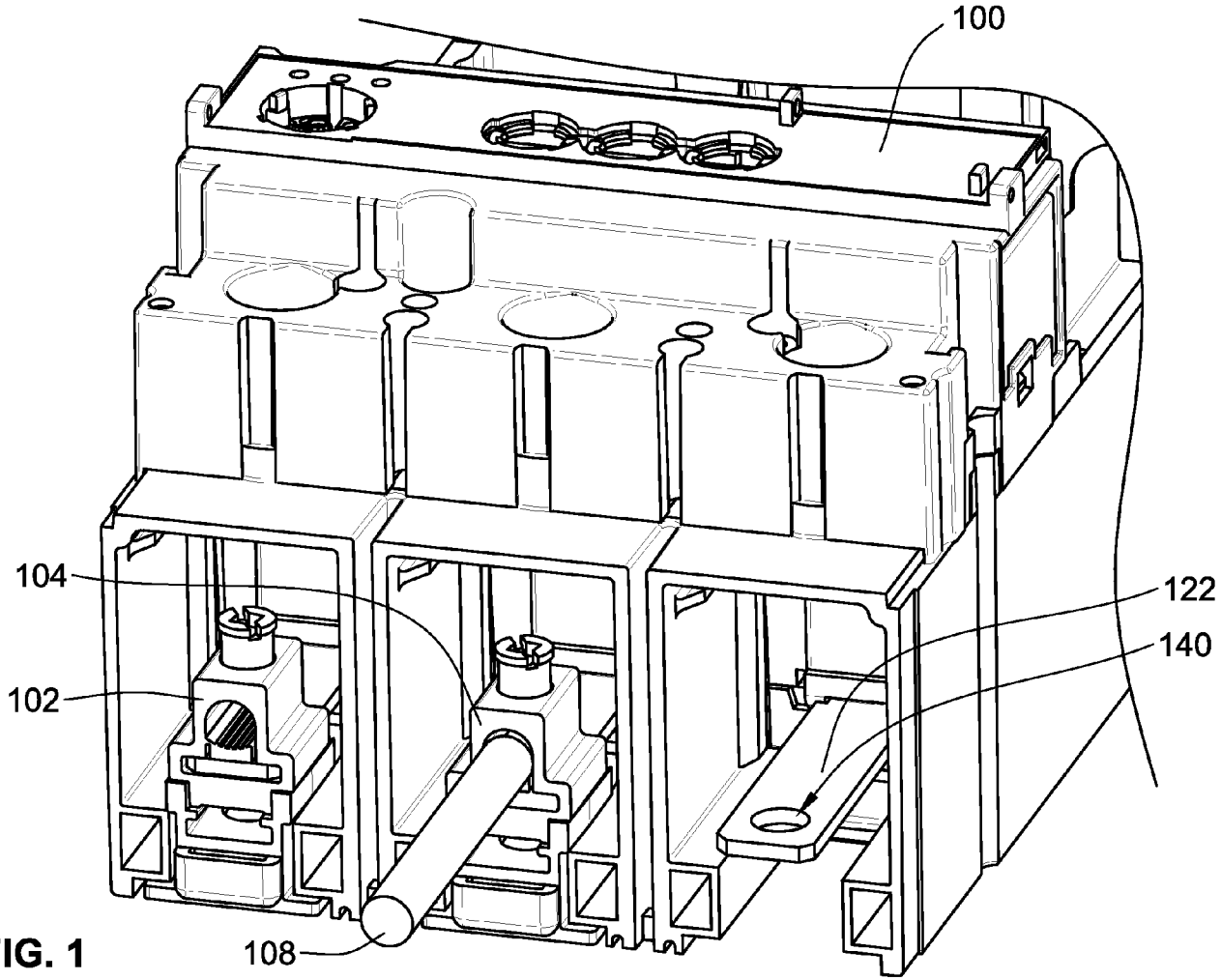
FIG. 1 is a perspective view of part of a circuit breaker having two lugs according to aspects of the present disclosure installed and an exposed terminal without a lug.

FIG. 1 is a perspective view of part of a piece of electrical distribution equipment 100 having two lugs 102, 104 according to aspects of the present disclosure installed, one with an electrical conductor or cable 108 installed and one without to expose a terminal of the piece of electrical distribution equipment. The piece of electrical distribution equipment can be, for example, a circuit breaker, a relay, a load center, a safety switch, a meter, a switchgear, or a contactor, and in the example illustrated in FIG. 1, the piece of electrical distribution equipment is a circuit breaker and for ease of discussion shall be referred to as such. Non-limiting examples of circuit breakers with suitable terminals for use with aspects of the present disclosure include the POWERPACT (e.g., H- and J-frame) and COMPACT line of circuit breakers and the QOM2 circuit breakers available from Schneider Electric.

Figure 4:
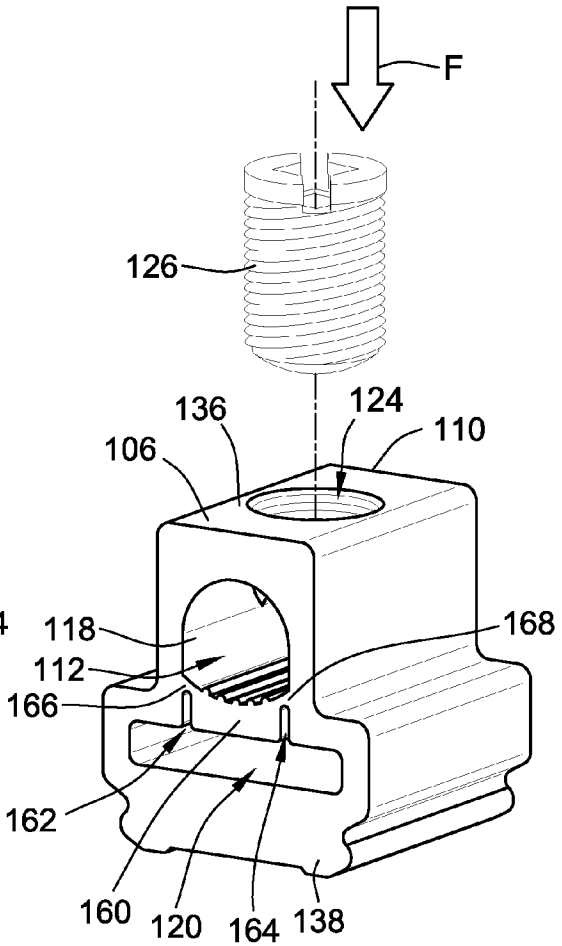
FIG. 4 is a perspective view of a lug having a shoe attached at either side by a respective hinge according to still another aspect of the present disclosure.
Figure 3:
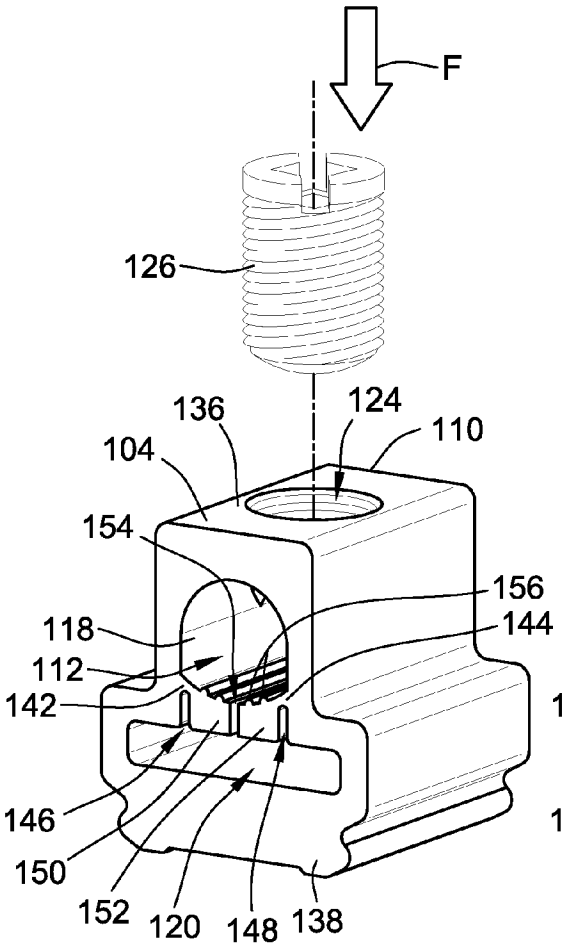
FIG. 3 is a perspective view of a lug having a pair of shoes each attached by respective hinges and separated by a gap according to another aspect of the present disclosure.
Figure 2:
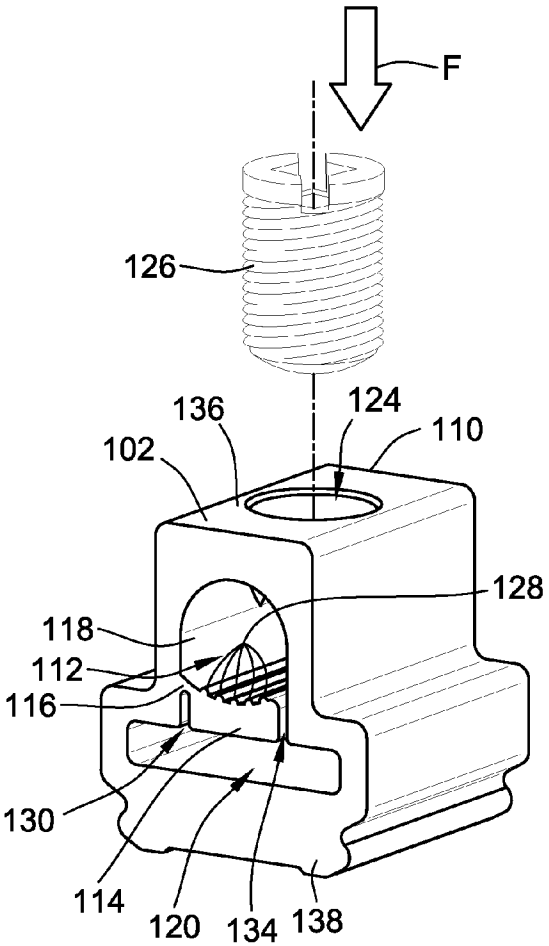
FIG. 2 is a perspective view of a lug having a shoe attached by a single hinge according to an aspect of the present disclosure.

The lugs 102, 104, 106 can be seen in more detail in FIGS. 2-4. Each of the lugs features one or more integrated shoes that are hinged to one or more inner wall surfaces of the housing. The lugs can feature one shoe hinged on one side to the inner wall (shown in FIG. 2) or two hinges on opposite inner walls of the housing (shown in FIG. 4), or two shoes hinged on opposite inner walls of the housing with a small gap between the two shoes to allow them to flex slightly in opposite directions (shown as a lug 104 in FIG. 3).

For convenience, the same reference numbers will be used to refer to the same components or features of the three different lugs described herein. Where the components or features differ among the lugs, different reference numbers are used. First, the common features among the lugs 102, 104, 106 will be described.

Each of the lug 102, 104, 106 includes a housing 110 and a cavity 112 in the housing 110 configured to receive an electrical conductor or cable 108 carrying electrical current in an electrical distribution system between the circuit breaker 100 and a power source or a load. Each lug 102, 104, 106 includes a shoe 114 having a hinge 116 connecting the shoe 114 to an inner wall 118 of the housing 110. Each lug 102, 104, 106 further includes a terminal-receiving slot 120 adjacent to the shoe 114 such that the shoe 114 is positioned between the cavity 112 and the terminal-receiving slot 120. In other words, the shoe 114 divides a chamber inside the housing 110 into the cavity 112 and the terminal-receiving slot 120. The terminal-receiving slot 120 is configured to receive therein a terminal 122 of the circuit breaker 100. The housing 110 includes a top surface 136 opposite a base portion 138. The terminal-receiving slot 120 is formed in the base portion 138. The base portion 138 can lack a screw hole as shown in FIGS. 2-8, or it can include a screw hole for receiving a screw through the bottom of the base portion 138 to secure the lug 102, 104, 106 to the terminal 122. Note that in some prior-art configurations, a screw hole is needed to secure the lug to the terminal, but in aspects of the present disclosure, the screw hole in the base portion 138 can be eliminated because the fastener 126 operates to secure both the conductor 108 and the terminal 122 to the lug 102, 104, 106. The terminal 122 is electrically connected to conventional internal components inside the circuit breaker 100, such as electromechanical devices and circuitry for detecting electrical faults and tripping the circuit breaker 100 when a fault is detected. The shoe 114 corresponds to a material interposed between the cavity 112 and the terminal-receiving slot 120 so that no part of the conductor 108 comes in direct physical contact with any part of the terminal 122. The shoe 114 and the cavity 112 are configured so as to be slightly larger than the largest diameter of a conductor 108 received within the cavity 112 and to have a shape commensurate with the cross-sectional shape of the conductor 108, which in this example is round or circular. Likewise, the shape and dimensions of the terminal-receiving slot 120 are configured to be slightly larger than the shape and dimensions of the terminal 122, which in this example has an elongated, thin rectangular form.

The hinge 116 extends along at least part of the length of the inner wall 118 parallel to a length of the conductor 108 when the conductor 108 is received in the cavity 112. For example, the hinge 116 can extend along the entire length of the inner wall 118. The hinge 116 can be formed by removing material to form a notch 130 in the shoe 114 where the shoe 114 is connected to the inner wall 118. In the case of the lug 120 (shown in FIG. 2), the shoe 114 is separated from a second inner wall 132 (shown in FIG. 6) of the housing 110 opposite the inner wall 118 by a gap 134 to allow the shoe 114 to deflect about the hinge 116.

Each lug 102, 104, 106 further includes a hole 124 (shown in FIG. 5) formed in the top surface 136 of the housing 110 leading to the cavity 112 for receiving through the hole 124 a fastener 126, such as a wire binding screw. A force indicated by arrow F applied to the top of the fastener 126 (such as in a direction toward the terminal-receiving slot 120) urges the conductor 108 when positioned in the cavity 112 (as shown in the lug 104 in FIG. 1) to clamp against the shoe 114 to cause the shoe 114 to deflect about the hinge 116. The clamping action presses against the terminal 122 when received in the terminal-receiving slot 120 to hold the lug 104 in a secure relationship relative to the terminal 122 and to hold the conductor 108 in a secure relationship relative to the lug 102, 104, 106. In other words, the force F applied to the fastener 126 (such as by screwing the fastener into the hole 124) accomplishes a double duty: first, it anchors the conductor 108 into the cavity 112 and clamps it down against the shoe 114; and second, the force is transferred to the conductor 108, which presses the shoe 114 against the terminal 122, securing the lug 102, 104, 106 to the terminal 122 of the circuit breaker 100. This avoids the need for a separate fastener to secure the terminal to the lug and the attendant additional manual installation step. To install, the operator simply slides the terminal-receiving slot 120 over the terminal 122, inserts the conductor 108 into the cavity 112, and tightens the fastener 126 until the conductor and the terminal are clamped to the lug 102, 104, 106.

The shoe 114 can have parallel-spaced grooves 128 running along a surface of the shoe 114 that faces away from the terminal-receiving slot 120 and toward the conductor 108 when received in the cavity 112. The grooves 128 can take the form of raised protrusions configured to penetrate through any oxidation on a surface of the conductor 108 to provide a reliable electrical connection between the conductor 108 and the terminal 122 to permit the electrical current to flow between the terminal 122 and the circuit breaker 100. The grooves 128 also operate to grip the conductor 108 when received in the cavity 112. The grooves 128 are not essential to the shoe 114, and it is equally contemplated that the shoe 114 lacks the grooves 128 and presents a smooth surface to the conductor 108.

The lug 102, 104, 106 can be formed as a unitary piece. The conductor 108, fastener 126, and the terminal 122 do not form part of the lug, but rather are external components that are coupled with the lug. The lug 102, 104, 106 can be extruded or cast from a mold or fabricated to form the unitary piece.

Due to the presence of the shoe 114, no part of the conductor 108 directly physically contacts the terminal 122 when the conductor 108 is securely received in the cavity 112 of the housing 110, such as shown in the middle lug 104 in FIG. 1. The shoe 114 serves as a clamp, pressing against the terminal 122 when the fastener 126 is tightened against the conductor 108. Of course, the shoe 114 is electrically conductive to ensure continuity of the electrical connection between the lug 102, which is itself electrically conductive, and the terminal 122. As mentioned above, the lug 102 can be casted, molded, or fabricated as a single unitary piece of a material composed of a metal or metal alloy. The material can be slightly malleable or deformable to allow the shoe 114 to flex or pivot about the hinge 116 and to allow the shoe 114 itself to deform slightly when the conductor 108 is pressed against the shoe 114 by an applied force F in the direction of the terminal 122.

As can be seen in the exposed terminal 122 shown in FIG. 1, the terminal 122 can include a hole 140 for fastening a bus bar or a crimp-on connector to the terminal 122 instead of the conductor 108. When this hole 140 is present in the terminal 122, in conventional lug configurations where the conductor directly contacts the terminal 122, the conductor can shear during tightening of the fastener. The shoe 114 prevents cable shearing when the hole 140 is present in the terminal 122 by interposing a structure between the conductor 108 and the terminal 122.

As mentioned above, the discussion has focused on the lug 102, but there are two other variations of the lug that are contemplated by the present disclosure. One such variation is illustrated in FIG. 3, in which the lug 104 has first and second hinges 142, 144 connected to first and second shoes 150, 152 that are separated by a small gap 154. Below the first and second hinges 142, 144 are corresponding notches 142, 148 to allow the shoes 150, 152 to deflect toward one another when the force F is applied to the conductor 108. The second hinge 144 is opposite the first hinge 142 and is connected to a second inner wall 132 of the housing 110 opposite the inner wall 118 such that the applied force F deflects the first shoe 150 and the second shoe 152 in opposite directions about the first hinge 142 and the second hinge 144, respectively, and to press the first and second shoes 150, 152 against the terminal 122.

Like the shoe 114 shown and described in FIG. 2, the second shoe 152 can have optional parallel-spaced grooves 156 running along a surface (facing toward the hole 124 and away from the terminal-receiving slot 120) of the second shoe 152 that faces away from the terminal-receiving slot 120. These grooves 156 serve to grip the conductor 108 when received in the cavity 112 and pierce through any oxidation that may be present on the surface of the portion of the conductor 108 that is received in the cavity 112.

Another variation is shown in FIG. 4, in which the lug 106 has first and second hinges 166, 168 connected to the first and second inner walls 118, 132, respectively, of the housing 110. Between the hinges 166, 168 is a single shoe 160 without any gap like the gap 154 shown in FIG. 3. The shoe 160 is made of a malleable or slightly deformable material composed of a metal or metal allow to allow the shoe 160 to deflect slightly under compression and to press against the terminal 122 beneath the shoe 160. Notches 162, 164 are formed under the hinges 166, 168 to facilitate this deflection movement of the shoe 160.

A comparison of FIGS. 5 and 6, which show perspective views of the lug 102 taken from opposite ends of the lug 102, reveals that the cavity 112 and the terminal-receiving slot 120 are open at both ends in these examples. In other aspects, either or both of the cavity 112 and the terminal-receiving slot 120 can be open at one end only. The terminal-receiving slot 120 is open at the end that receives the terminal 122, and the cavity 112 is open at the end that receives the conductor 108. In the illustrated aspects, this means that the cavity 112 is open at one end of the lug 102, 104, 106, whereas the terminal-receiving slot 120 is open at the opposite end of the lug 102, 104, 106. In these figures, we also show that the conductor 108 conventionally includes an insulating sheath 170 that surrounds an electrically conductive portion 172. Part of the insulating sheath 170 has been removed to expose the electrically conductive portion 172 so that it can be received in the cavity 112. To the extent any oxidation is present on the exposed electrical conductive portion 172, the grooves 128, 156 are configured to penetrate through any such oxidation for a reliable electrical connection between the exposed electrical conductive portion 172 and the lug 102, 104, 106. The grooves 128, 156 generally take the form of raised V- or U-shaped protrusions configured to grip the conductor 108 and penetrate through any oxidation present on the exposed surface of the portion of the conductor 108 that is received in the cavity 112.

Figure 8:
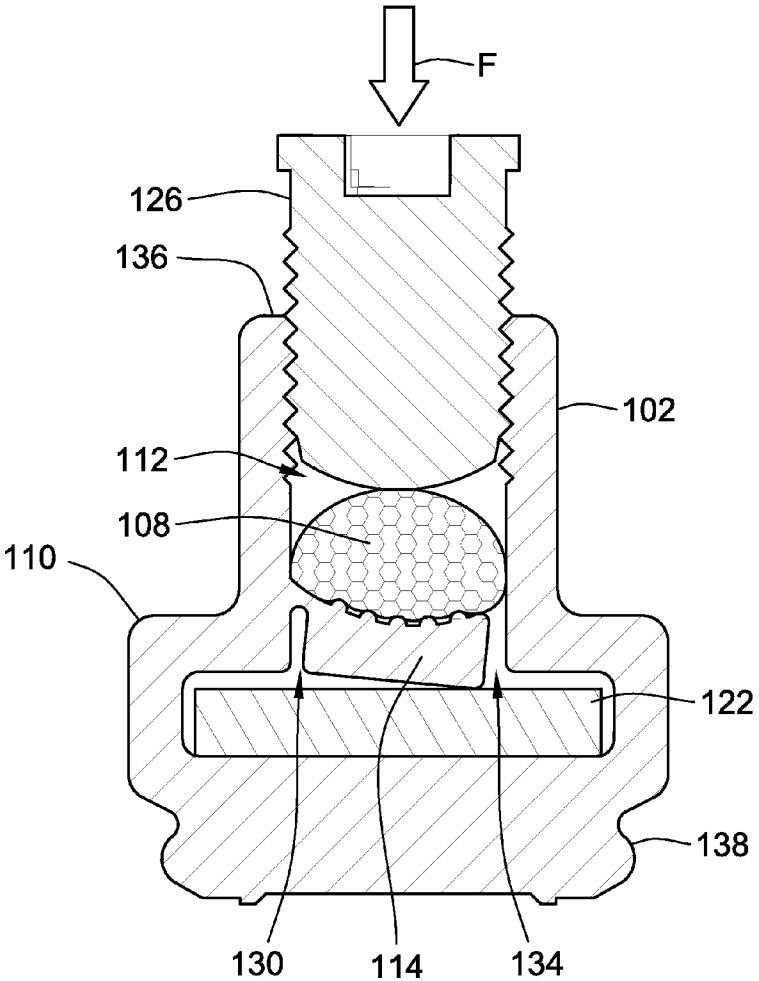
FIG. 8 is a cross-sectional view of the lug shown in FIG. 7 with the fastener tightened down against the conductor, clamping the shoe against the terminal to secure both the conductor and the terminal to the lug.
Figure 7:
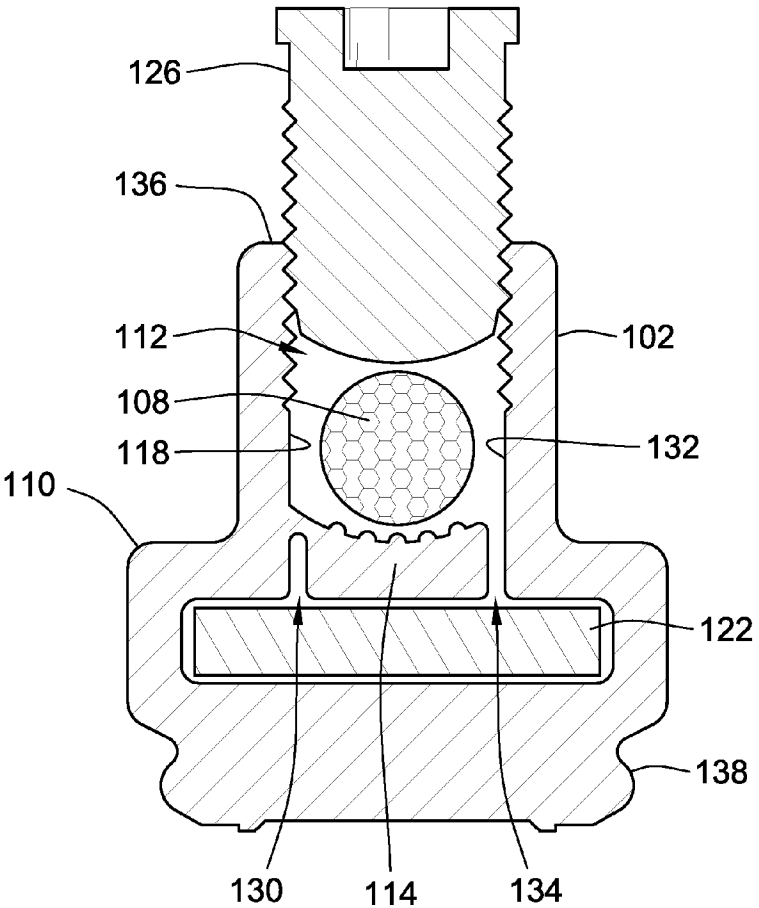
FIG. 7 is a cross-sectional view of the lug shown in FIG. 2 with a fastener that is about to be tightened to clamp down a conductor.

FIGS. 7 and 8 illustrate how the fastener 126, when tightened against the conductor 108, compresses the conductor 108 and causes the shoe 114 to deflect and clamp against the terminal 122. The extent of the deformation of the conductor 108 has been slightly exaggerated in FIG. 8 to illustrate the point. In FIG. 7, the conductor 108 is received in the cavity 112, the lug 102 is positioned relative to the terminal 122 such that the terminal 122 is received in the terminal-receiving slot 120, and the fastener 126, which in this example is a threaded wire binding screw, is tightened in a direction toward the terminal 122. In FIG. 8, as the fastener 126 is tightened, the conductor 108 deforms slightly, pressing against the shoe 114, which clamps down on the terminal 122. The shoe 114 deflects or pivots slightly about its hinge 116, thanks to the presence of the gap 134 opposite the hinge 116. As a result, not only is the conductor 108 securely held in place in the cavity 112 relative to the shoe 114, but also the terminal 122 is securely clamped in place relative to the lug 102. A single applied force (by tightening the fastener 126) to the fastener 126 is all that is required to clamp both the conductor 108 and the terminal 122 into place within the lug 102, 104, 106.

While particular embodiments and applications of the present invention have been illustrated and described, it is to be understood that the invention is not limited to the precise construction and compositions disclosed herein and that various modifications, changes, and variations can be apparent from the foregoing descriptions without departing from the scope of the invention as defined in the appended claims.

What is claimed is:

1. A lug, comprising:

a housing;

a cavity in the housing configured to receive an electrical conductor carrying electrical current;

a shoe having a hinge connecting the shoe to an inner wall of the housing;

a terminal-receiving slot adjacent to the shoe such that the shoe is positioned between the cavity and the terminal-receiving slot, the terminal-receiving slot being configured to receive therein a terminal of a piece of electrical distribution equipment;

a hole in the housing leading to the cavity for receiving through the hole a fastener, wherein a force applied to the fastener urges the conductor when positioned in the cavity to clamp against the shoe to cause the shoe to deflect about the hinge and to press against the terminal when received in the terminal-receiving slot to hold the lug in a secure relationship relative to the terminal and to hold the conductor in a secure relationship relative to the lug.

2. The lug of claim 1, the shoe further having parallel-spaced grooves running along a surface of the shoe that faces away from the terminal-receiving slot.

3. The lug of claim 2, wherein the grooves include raised protrusions configured to penetrate through any oxidation on a surface of the conductor to provide a reliable electrical connection between the conductor and the terminal to permit the electrical current to flow between the terminal and the piece of electrical distribution equipment.

4. The lug of claim 1, further comprising a second shoe having a second hinge opposite the hinge and connected to a second inner wall of the housing opposite the inner wall such that the applied force deflects the shoe and the second shoe in opposite directions about the hinge and the second hinge, respectively, and to press the shoe and the second shoe against the terminal.

5. The lug of claim 4, wherein the second shoe has parallel-spaced grooves running along a surface of the second shoe that faces away from the terminal-receiving slot.

6. The lug of claim 4, wherein the shoe and the second shoe are separated from one another by a gap.

7. The lug of claim 1, wherein the hinge extends along an entire length of the inner wall parallel to a length of the conductor.

8. The lug of claim 1, wherein the cavity and the terminal-receiving slot are open at both ends.

9. The lug of claim 1, wherein the lug is formed as a unitary piece.

10. The lug of claim 9, wherein the lug is extruded from a mold to form the unitary piece.

11. The lug of claim 1, wherein the housing includes a top surface opposite a base, the terminal-receiving slot being formed in the base and the hole being formed through the top surface.

12. The lug of claim 1, wherein the fastener is a wire binding screw, and wherein the applied force is in a direction toward the terminal-receiving slot.

13. The lug of claim 1, wherein the shoe is separated from a second inner wall of the housing opposite the inner wall by a gap to allow the shoe to deflect about the hinge.

14. The lug of claim 1, wherein no part of the conductor directly physically contacts the terminal when the conductor is securely received in the cavity of the housing.

15. The lug of claim 1, wherein the piece of electrical distribution equipment is a circuit breaker, a relay, a load center, a safety switch, a meter, a switchgear, or a contactor.

16. A lug, comprising:

a housing;

a cavity in the housing configured to receive an electrical conductor carrying electrical current;

a first shoe having a first hinge connecting the first shoe to a first inner wall of the housing;

a second shoe having a second hinge opposite the first hinge and connected to a second inner wall of the housing opposite the first inner wall;

a terminal-receiving slot adjacent to the first and second shoes such that the first and second shoes are positioned between the cavity and the terminal-receiving slot, the terminal-receiving slot being configured to receive therein a terminal of a piece of electrical distribution equipment;

a hole in the housing leading to the cavity for receiving through the hole a fastener, wherein a force applied to the fastener urges the conductor when positioned in the cavity to clamp against the first and second shoes to cause the first shoe to deflect about the first hinge in a first direction and the second shoe to deflect about the second hinge in a second direction opposite the first direction such that the first and second shoes press against the terminal when received in the terminal-receiving slot to hold the lug in a secure relationship relative to the terminal and to hold the conductor in a secure relationship relative to the lug.

17. The lug of claim 16, wherein the first shoe has parallel-spaced grooves running along a surface of the first shoe that faces away from the terminal-receiving slot and the second shoe has parallel-spaced grooves running along a surface of the second shoe that also faces away from the terminal-receiving slot.

18. The lug of claim 17, wherein the lug is formed as a unitary piece and wherein the first shoe and the second shoe are separated from one another by a gap.

* * * * *